US005264069A

United States Patent [19]

Dietrich et al.

[11] Patent Number: 5,264,069

[45] Date of Patent: Nov. 23, 1993

[54] DEVICE FOR JOINING A TWO-DIMENSIONAL COMPOUND WORKPIECE

[75] Inventors: Herbert Dietrich; Günther Mall, both of Kaiserslautern, Fed. Rep. of Germany

[73] Assignee: G. M. Pfaff Aktiengesellshcaft, Kaiserlautern, Fed. Rep. of Germany

[21] Appl. No.: 693,453

[22] Filed: Apr. 29, 1991

[30] Foreign Application Priority Data

May 9, 1990 [DE] Fed. Rep. of Germany ..... 4014797

[51] Int. Cl.[5] ..... B32B 31/00

[52] U.S. Cl. ..... 156/559; 156/539; 156/556; 156/580; 12/1 W; 12/52; 12/122; 12/123; 269/21

[58] Field of Search ..... 156/539, 556, 559, 580, 156/557, 558; 100/207; 269/21; 12/1 W, 52, 122, 123

[56] References Cited

U.S. PATENT DOCUMENTS 3,988,993 11/1976 Brophy ..... 112/121.12
3,996,088 12/1976 Crouch ..... 156/211
4,212,699 7/1980 Braunschweiler ..... 156/558
4,557,134 12/1985 Kuppinger ..... 100/207 X
4,629,527 12/1986 Livi et al. ..... 156/285
5,098,508 3/1992 Mattil ..... 156/363

*Primary Examiner*—David A. Simmons
*Assistant Examiner*—J. Sells
*Attorney, Agent, or Firm*—McGlew and Tuttle

[57] ABSTRACT

The device has a support plate (119) provided with drive means (112, 117) for at least one lower part, as well as a plurality of holding plates (85) arranged in one row with an upper receiving surface and a lower receiving surface (93, 94), respectively, for a plurality of upper parts. The holding plates (85) can be rotated through 180° by means of a pivoting device (86, 87, 108) around a symmetrical horizontal axis (L3). After the upper parts have been placed on the holding plates (85), adhesive is applied to the edges of the upper parts, after which the holding plates (85) are pivoted through 180°. The support plate (119) subsequently gathers the upper parts, which are now hanging down, while at the same time the next upper parts can be placed over the receiving surfaces of the holding plates (85), which [receiving surfaces] are now facing upward. The support plate (119) and the holding plates (85) are designed as suction plates that can be turned on and off.

14 Claims, 4 Drawing Sheets

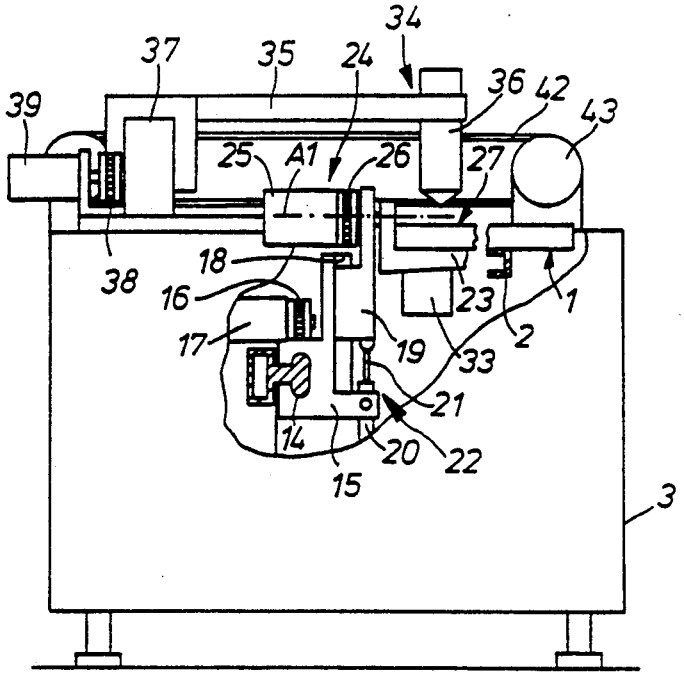
Fig. 1
Fig. 2
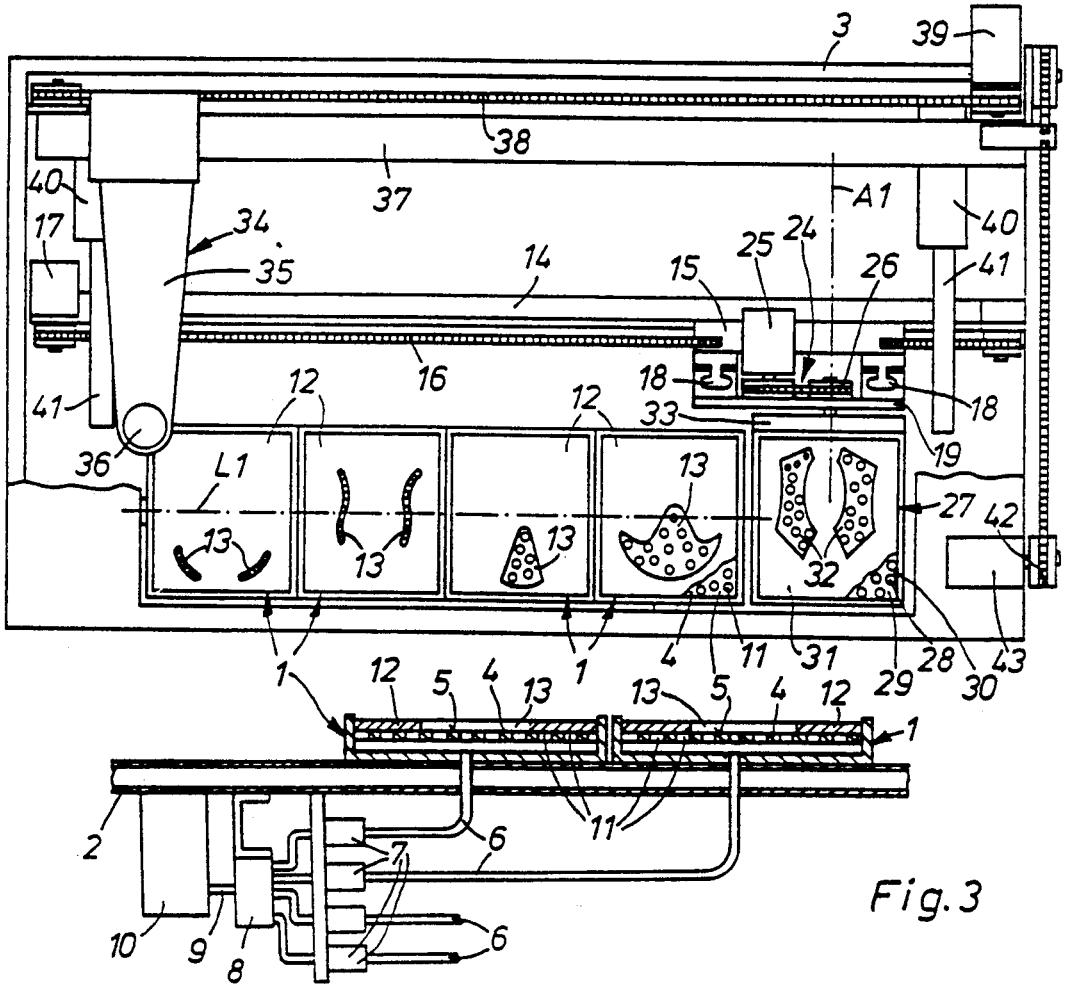
Fig. 3

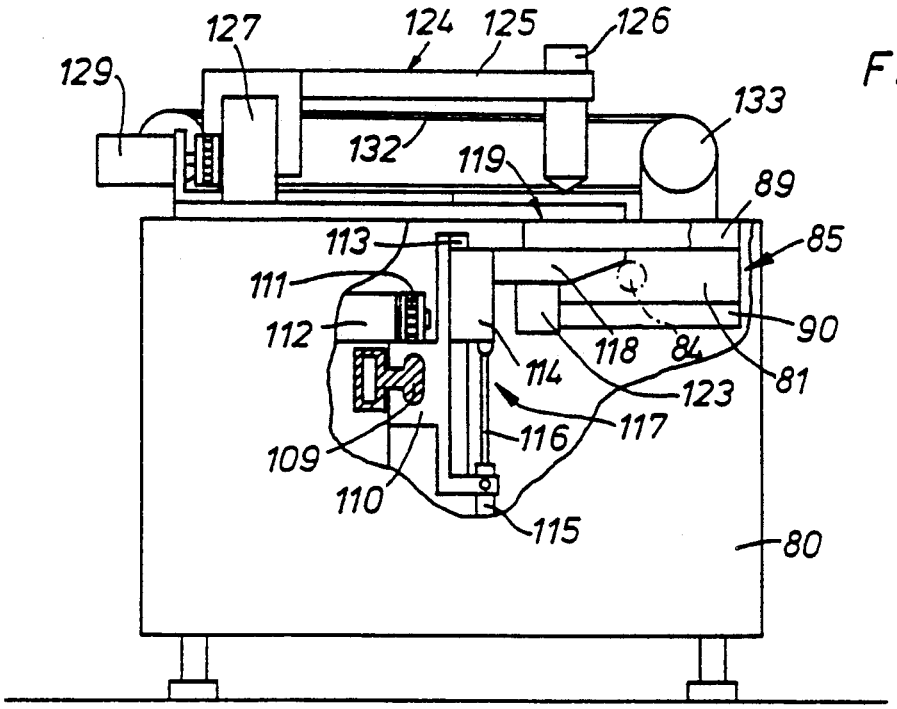
Fig.7
Fig. 8
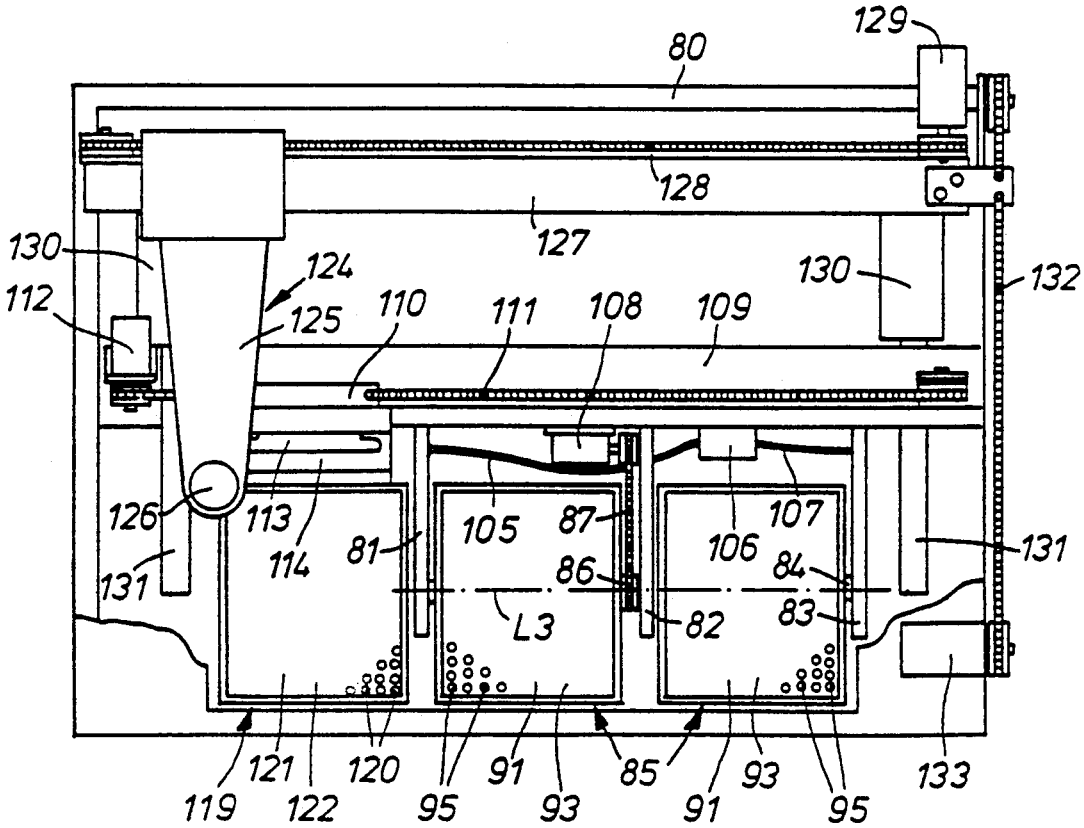

DEVICE FOR JOINING A TWO-DIMENSIONAL COMPOUND WORKPIECE

FIELD OF THE INVENTION

The present invention pertains to a device for joining a two-dimensional compound workpiece consisting of one lower part and one or several upper parts, e.g., a shoe upper consisting of a plurality of parts, with at least one support plate for at least one lower part and with holding plates for the upper parts, the holding plates and/or support plates include holding arrangements for holding workpiece parts, and driving devices for moving between the support plate and the holding plate in order to apply the upper part to the lower part.

BACKGROUND OF THE INVENTION

U.S. Pat. No. 3,988,993 discloses a workpiece holder designed for automatic sewing machines, which has a plurality of pick-up and clamping plates for picking up a plurality of workpiece parts to be joined together into one two-dimensional compound workpiece. Since this workpiece holder also acts as a sewing template, it must be of a relatively stable design, as a consequence of which its manufacture is rather expensive. Since the slots through which the needle passes in a sewing template should be spaced as closely as possible to one another, if such a workpiece holder is used for making shoes, it is necessary to provide separate workpiece holders not only for different styles, but even for the different sizes of one and the same style, so that even this leads to an increased expense depending on the number of different styles and sizes. The use of clamping plates with a central, continuous opening for the passage of the needle leads furthermore to the circumstance that the edge distance in the case of edge-parallel seams cannot be reduced below a defined, relatively great-value.

In U.S. Pat. No. 4,557,134 (corresponding to unpublished West German Patent Application No. P 38,37,516.8), a device is used to fix in the correct position on the lower part a plurality of upper parts to be placed on a lower part by bonding, after which the workpiece parts can be sewn together without problems by forming, e.g., an edge-parallel seam at a short distance from the edge. The device contains a central, stationary bench plate for the lower part and a plurality of folding plates for the upper parts, which plate is hinged to the outside of the bench plate, wherein the bench plate and the folding plates are connected to one suction device each for holding the workpiece parts. Before the folding plates are folded over, adhesive is applied by an adhesive applying device onto the upper parts placed on the folding plates in a defined manner. If a plurality of folding plates are needed to pick up a greater number of overlapping workpiece parts or workpiece parts that are placed over one another, these are hinged next to one another to the bench plate having a corresponding polygonal shape, so that the folding plates extend around the bench plate in a wreath-like pattern. However, in the case of a corresponding plate size, such an arrangement leads to difficulties in feeding the distant bench plate, wherein the operator must move to and fro along the folding plates to feed them, and the distance covered by the operator is particularly long because of the arc-shaped arrangement of the folding plates.

SUMMARY AND OBJECTS OF THE INVENTION

It is an object of the present invention to provide a device for joining workpiece parts into a two-dimensional compound workpiece, in which the workpiece parts can be laid down in the simplest possible manner.

According to the invention, a device for joining a two-dimensional compound workpiece such as a workpiece consisting of one lower part and one or several upper parts, e.g., a shoe upper consisting of a plurality of parts, is provided including at least one support plate for at least one lower part and holding plates for upper parts. One of the support plates and holding plates have holding means for holding a workpiece part to the support plate and the holding plate. A driving means is provided for performing relative movements between the support plate and the holding plate in order to apply the upper part to the lower part. The holding plates are arranged next to one another essentially along a longitudinal axis extending substantially horizontally. The support plate is moveable by the drive means from a support plate starting position, which is preferably on one side of an outer holding plate or in an edge area of the device, relative to the holding plates, substantially parallel to the longitudinal axis of the holding plates and at right angles to the longitudinal axis of the holding plates such that a receiving surface carrying the lower part can be successively positioned in a plurality of predeterminable positions relative to a receiving surface of the holding plate, said receiving surface carrying at least one upper part in which the respective receiving surfaces of the support plate and one of the holding plates are opposite each other.

By performing the relative movements between the different plates of the device, which are necessary for joining the workpiece parts, with a support plate receiving the lower part and moving it, section by section, along the holding plates receiving the upper parts, the support plate can be moved into a starting position located on the side of the holding plates or at the edge of the device, in which starting position it is easily accessible, so that the operator is able to place the lower part on its support surface without any particular effort or contorting movement.

If the device has a greater number of holding plates, it is achieved—by taking another measure, according to which they are arranged next to one another in a straight line—that the operator has to cover a shorter distance while feeding the holding plates than in the case of a wreath-like arrangement of such plates on the circumferential side of a central plate.

The driving means may be provided as a slide wherein the support plate is arranged on the slide and wherein the slide may be moved along a guide rail extending in parallel to the longitudinal axis of the holding plates. The slide is connected to a positioning drive and may be moved by a lifting device at right angles to the receiving surface of the holding plates and which can be pivoted by a pivoting device around a horizontal axis, extending at right angle to the longitudinal axis of the holding plates, between a starting position in which the receiving surface is at the top and a transfer position, in which the receiving surface is at the bottom.

The drive means may also be provided in which the support plate is arranged on a slide which can be moved along a guide rail extending in parallel to the longitudinal axis of the holding plates which is connected to a positioning drive and can be pivoted by means of a pivoting device around an additional axis which extends in parallel to the longitudinal axis of the holding plate, for movement between the staring position and the transfer position wherein in the starting position the support plate is located behind one of the outer holding plates, positioned with the receiving surface at the top, essentially in the same plane as the receiving surface of the holding plates, and in the transfer position in which the receiving surface is at the bottom and overlaps one of the holding plates.

The drive means may also be provided such that the holding plates have one receiving surface on each side and can be pivoted by a pivoting device symmetrically around a longitudinal axis, and the support plate is arranged on a slide moveable in parallel to the longitudinal axis and connected to both a positioning drive and a lifting device in order to be lowered from its starting position, located on a side of an outer holding plate, in which its receiving surfaces is essentially flush with the upper receiving surfaces of the holding plates, into a plane located beneath the lower receiving surface of the holding plates, and can be successively positioned in this plane in a plurality of predeterminable positions relative to the receiving surfaces of the holding plates.

These features of the drive means including arrangements for moving one of the support plate and holding plate, provide significant advantages. Among these, the variant providing holding plates with receiving surfaces on each side which can be pivoted by pivoting devices, offers the particular additional advantage that an overlapped mode of operation is possible in a device of such a design by turning over the holding plates after they have been fed, after which the support plate, being moved along under the holding plates step by step, will gather the upper parts hanging on the support surfaces facing down one after another, while new upper parts can be placed on the upwardly facing receiving surfaces and can be provided with adhesive.

The variant according to the invention in which a second support plate is associated with the first support plate and the second support plate can be moved, independently from the movements of the first support plate, from a starting position along a path corresponding to the path of the first support plate by means of drives corresponding to the positioning drive or to the lifting device of the first support plate, leads to an even higher degree of time-overlapped operation, because not only can the next upper parts be placed on the receiving surfaces of the holding plates facing upward, but the next lower part can also be placed over the second support plate resting in its starting position during the gathering of the upper parts hanging on the receiving surfaces of the holding plates facing downward.

In the embodiment according to the invention including both of the features of the holding plate having one receiving surface on each side connected to a pivoting device and a second support plate associated with the first support plate, the upper parts hanging on the receiving surfaces of the holding plates facing downward can be gathered such that the support plate is at a small vertically spaced distance from the corresponding receiving surface in the transfer position, and the holding means associated with the corresponding holding plate are put out of operation, after which the upper parts will drop only onto the lower part lying on the support plate. Another possibility for gathering the upper parts, according to the invention is an arrangement in which the support plate or the support plates can be raised in the positioning locations into the zone of the receiving surfaces of the holding plates, as a result of which the lower part and the upper parts that are already arranged on it are brought into direct contact with the next upper part to be picked up.

According to another aspect of the invention the holding means of the support plate and/or the holding plates are realized in that these plates are designed as chambers, are provided with passage holes, and can be connected to a suction blower. The holding plates used in the embodiment according to the invention in which the holding device has one receiving surface on each side and can be pivoted in which the support plates can be raised in the positioning locations into the zone of lower receiving surfaces of the holding plates, are designed as double chambers into which pressure can be admitted individually.

The present invention will be explained below on the basis of three embodiments represented in the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiments of the invention are illustrated.

BRIEF DESCRIPTION OF THE DRAWINGS

In the drawings:

FIG. 1 is a side view of the device according to the first embodiment of the invention;

FIG. 2 is a top view of the device according to FIG. 1;

FIG. 3 is a partially cutaway view, according to the first embodiment of the invention of two holding plates represented on a larger scale;

FIG. 7 is a side view of the device according to the third embodiment according to the invention;

FIG. 8 is a top view of the device according to FIG. 7; and

DETAILED DESCRIPTION OF THE PREFERRED EMBODIMENTS

Figure 4:
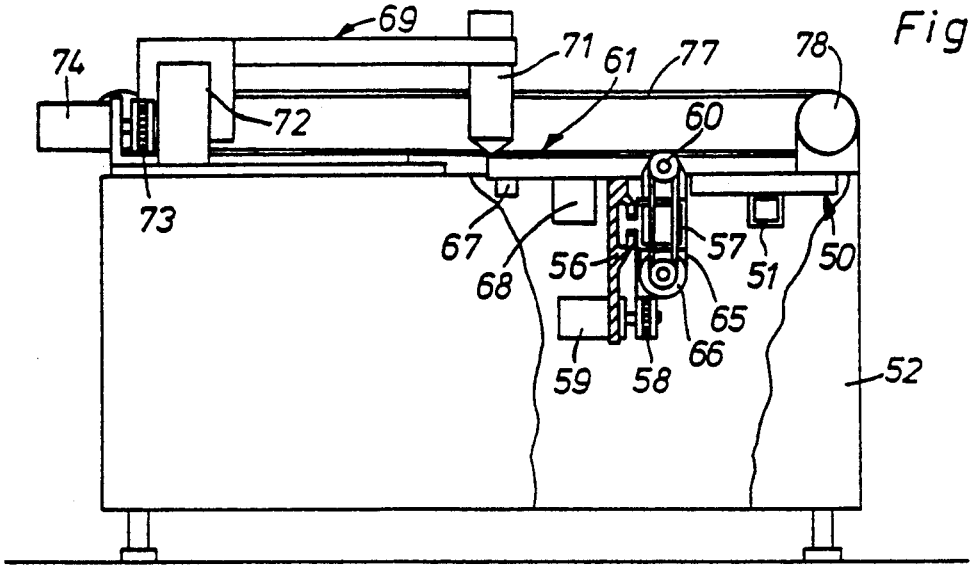
FIG. 4 is a side view of the device according to the second embodiment according to the invention.

Embodiment 1:

Referring to the drawings and in particular FIGS. 1–3, a first embodiment according to the invention comprises a device having four holding plates 1, which are fastened on a holder 2 of a frame 3 and are arranged next to one another in a row along a horizontally extending longitudinal axis L1. The holding plates 1 are designed as chambers separated from one another, and have a recessed receiving plate 4 with a receiving surface 5 located in the horizontal plane. As is shown in FIG. 3, the individual holding plates 1 are connected to a suction blower 10 via a separate hose pipe 6 each, a directional control value 7 each, a distributor 8 each, and a common hose pipe 9. A plurality of passage holes 11 are provided in the receiving plate 4 of each holding plate 1. A flat template 12, which has openings 13 for receiving upper parts of appropriate shape (not shown) in the correct position, is detachably fastened to each receiving plate 4. Thus, the templates 12 are used as orienting means for the upper parts, on one hand, and to cover the passage holes 11 that are not needed for holding the upper parts.

A slide 15 is provided arranged displaceably on a guide rail 14 extending in parallel to the longitudinal axis L1. The slide 15 is connected to a positioning motor 17 via a chain drive 16. Another slide 19 is arranged displaceably on two vertically extending guide rails 18 arranged at the slide 15. A pneumatic cylinder 20, whose piston rod 21 is connected to the slide 19, is fastened to the slide 15. The slide 19 and the pneumatic cylinder 20 form a lifting device 22. An L-shaped holder 23 is mounted on the slide 19 pivotably around a horizontal axis Al extending at right angles to the longitudinal axis L1. The holder 23 is connected to a pivoting device 24, which consists of a positioning motor 25 fastened on the slide 19 and of a chain drive 26. A support plate 27 for one or several lower parts (not shown) is fastened to the holder 23.

Like the holding plates 1, the support plate 27 is designed as a chamber, and therefore has a recessed receiving plate 29, which is provided with passage holes and whose top side, which is in a horizontal plane, forms a receiving surface 30. A flat template 31, which has two openings 32 for two lower parts (not shown), is detachably fastened to the receiving plate 29. A suction blower 33, which communicates with the cavity of the support plate 27 located beneath the receiving plate 29 in a manner not shown, is fastened on the underside of the holder 23.

A program-controlled adhesive applying device 34 has an adhesive applying head 36 arranged on a bracket arm 35. The bracket arm 35 is mounted displaceably on a rail-like longitudinal slide 37 extending in parallel to the longitudinal axis L1, and is connected to a positioning motor 39 arranged on the longitudinal slide 37 via a chain drive 38. The longitudinal slide 37 is arranged displaceably, via two cross slides 40, on two guide bars 41 extending at right angles to the longitudinal axis L1, and is connected to a positioning motor 43 via a chain drive 42. When the chain drive 42 acts at one end of the longitudinal slide 37, as is shown in FIG. 2, it may be advantageous to also transmit the driving movements of the positioning motor 43 to the other end of the longitudinal slide 37 via appropriate transmission members (not shown), as a result of which the longitudinal slide 37 will be prevented from tilting.

At the beginning of a joining process, the support plate 27 is in the starting position shown in FIGS. 1 and 2, in which the receiving surface 30 is at the top. The individual workpiece parts are now placed into the openings 13 and 32 of the templates 12 and 31 on the free parts of the receiving surfaces 5 and 30 of the holding plates 1 and the support plate 27, and the suction blowers 10 and 33 are subsequently turned on, and the directional control valves 7 are opened, as a result of which the workpiece parts are held by suction on the receiving surfaces 5 and 30.

Using the adhesive applying device 34, adhesive is subsequently applied to the upper parts arranged on the holding plates 1, such that adhesive is always applied to the edge sections which will later overlap when the workpiece parts have been joined. The application of adhesive is begun with the holding plate 1 located on the right in FIG. 2, which is directly adjacent to the support plate 27 remaining in the starting position.

During the application of adhesive to the upper part located on the holding plate 1 located on the right, the support plate 27 is turned through 180° around the axis A1 by the pivoting device 24, after which the receiving surface 30 with the lower part will be at the bottom. Furthermore, the slide 19 together with the support plate 27 is raised by the lifting device 22 to the extent that the underside of the support plate 27 and the lower part will be at a vertically spaced location from the top side of the holding plates 1 and the upper parts.

As soon as the adhesive applying head 36 has been moved on to the second holding plate 1, so that the holding plate 1 located on the right is free, the support plate 27 is moved with the positioning motor 17 over the holding plate 1, and then lowered by the lifting device 22 to the extent that the two lower parts and the upper part will touch one another in the overlapping zone and will be bonded together by the adhesive. The directional control valve 7 associated with the holding plate 1 is closed, and the suction air and consequently the holding action are thus interrupted. The support plate 27 is subsequently raised, and the upper part adhering to the two lower parts is lifted out of the template 12 of the holding plate 1.

As soon as the adhesive applying head 36 has been moved on to the third holding plate 1, the support plate 27 is moved over the holding plate 1, which has just become free, and the next upper part is gathered by repeated lowering. All upper parts are thus gathered one after another, as a result of which a multilayer compound workpiece is formed, which can be removed from the support plate 27 for performing the subsequent processing operation after repeatedly lowering the support plate 27 and turning off the suction blower 33.

Embodiment 2

Figure 5:
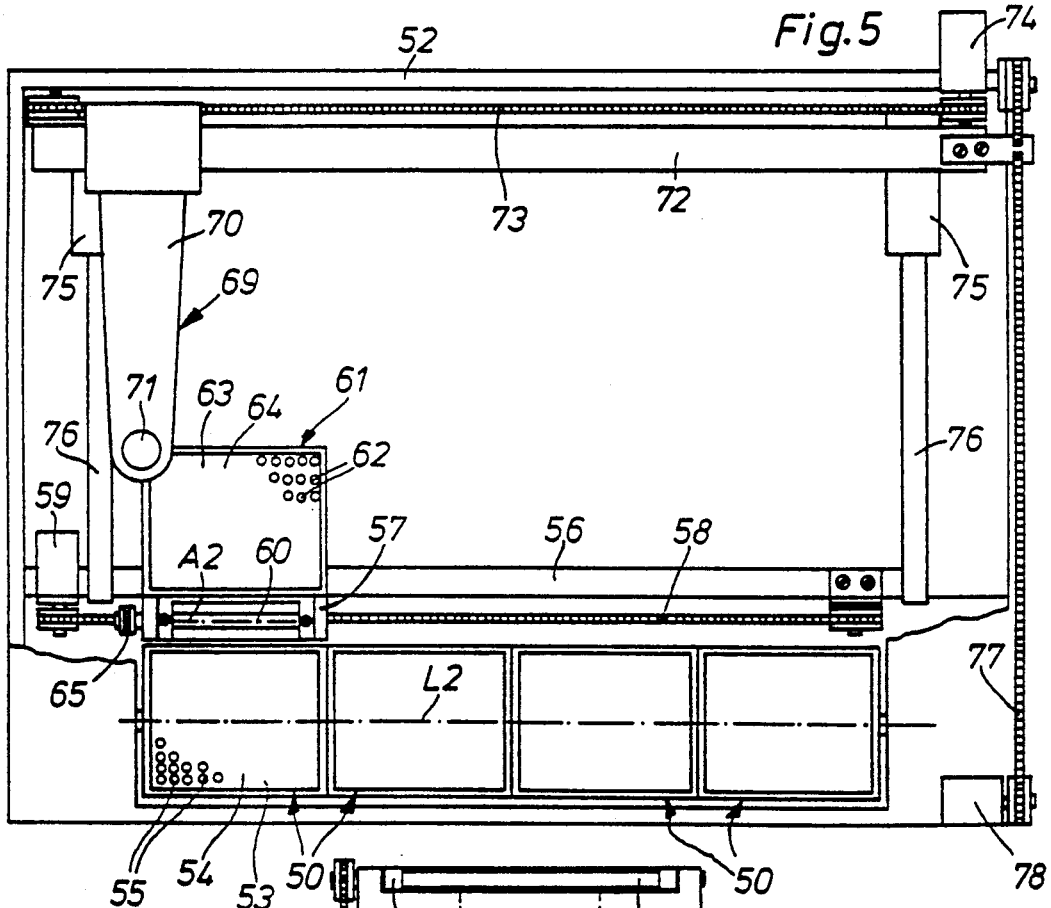
FIG. 5 is a top view of the device according to FIG. 4.
Figure 6:
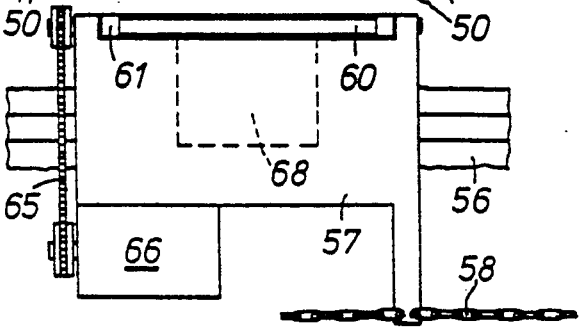
FIG. 6 is an enlarged detail of the holder of the support plate according to the second embodiment of the invention.

The device shown in FIGS. 4 through 6 has, like the device according to the first embodiment, four holding plates 50, which are fastened on a holder 51 of a frame 52 and are arranged next to one another in a row along a horizontally extending longitudinal axis L2. Like the holding plates 1 of the first embodiment, the holding plates 50 are designed as chambers that are separated from one another, and have a recessed receiving plate 53 with a receiving surface 54 located in a horizontal plane.

Like the holding plates 1 of the first embodiment, the holding plates 50 are connected to a blower (not shown) via connection members and valves (not shown). Passage holes 55 are provided in the receiving plate 53 of each the holding plate 50. In the same manner as in the case of the receiving plates 4 of the first embodiment, templates (not shown) for the upper parts can be detachably fastened on the receiving plates 53.

A slide is arranged displaceably on a guide rail 56 extending in parallel to the longitudinal axis L2. The slide 57 is connected to a positioning motor 59 via a chain drive 58. A support plate 61 is arranged nonrotatably on a shaft 60 that is mounted in the slide 57 and extends in parallel to the longitudinal axis L2. Like the support plate 27 of the first embodiment, the support plate 61 is designed as a chamber, and a recessed receiving plate 63, which is provided with passage holes 62 and whose top side, lying in a horizontal plane, forms a receiving surface 64. A template (not shown) for one or several lower parts can be placed on the receiving plate 63.

The shaft 60 carrying the support plate 61 is connected to a positioning motor 66 via a chain drive 65. In the starting position shown in the drawing, the support plate 61 is in an easily accessible peripheral position relative to the frame 52 and is supported by a stop 67 securing the pivoted position of the support plate 61. A suction blower 68, which is connected to the cavity beneath the receiving plate 63 in a manner not shown, is fastened on the underside of the support plate 61.

A program-controlled adhesive applying device 69 is designed in the same manner as the adhesive applying device 34 of the first embodiment, and therefore it comprises an adhesive applying head 71 arranged on a bracket arm 70. The bracket arm 70 is mounted displaceably on a rail-like longitudinal slide 72, and is connected via a chain drive 73 to a positioning motor 74 fastened to the longitudinal slide 72. The longitudinal slide 72 is arranged displaceably, via two cross slides 75, on two guide bars 76 extending at right angles to the longitudinal axis L2, and is connected to a positioning motor 78 via a chain drive 77.

At the beginning of a joining process, the support plate 61 is in the starting position shown in FIGS. 4 and 5, in which the receiving surface 64 is at the top. The individual workpiece parts are now placed over the receiving surfaces 54 and 64 of the holding plates 50 and the support plate 61, and the suction blower (not shown) of the holding plates 50 and the suction blower 68 of the support plate 61 are turned on, as a result of which the workpiece parts are fixed on the plates 50 and 61.

Using the adhesive applying device 69, adhesive is then applied to the upper parts arranged on the holding plates 50, and this process is begun with the holding plate 50 located on the left in FIG. 5, which holding plate 50 is directly adjacent to the support plate 61 remaining in the starting position.

As soon as the adhesive applying head 71 has been moved on to the second holding plate 50, the support plate 61 is pivoted by means of the positioning motor 66 around the longitudinal axis A2 of the shaft 60 onto the holding plate 50 on the left, as a result of which the lower part and the upper part will touch one another in their overlapping zone and are bonded together by the adhesive. The holding action produced by the suction air is then interrupted in the holding plate 50, and the support plate 61 is again pivoted back into the starting position, and the upper part adhering to the lower part is lifted off from the holding plate 50.

As soon as the adhesive applying head 71 has been moved on to the third holding plate 50, the support plate 61 is moved into the zone of the second holding plate 50 by means of the positioning motor 59, and the next upper part is gathered by repeated tilting. All upper parts are thus gathered one after another, as a result of which a multilayer compound workpiece is formed, which can be removed from the support plate 61 by folding back the support plate 61 and turning off the suction blower 68.

Embodiment 3

Figure 9:
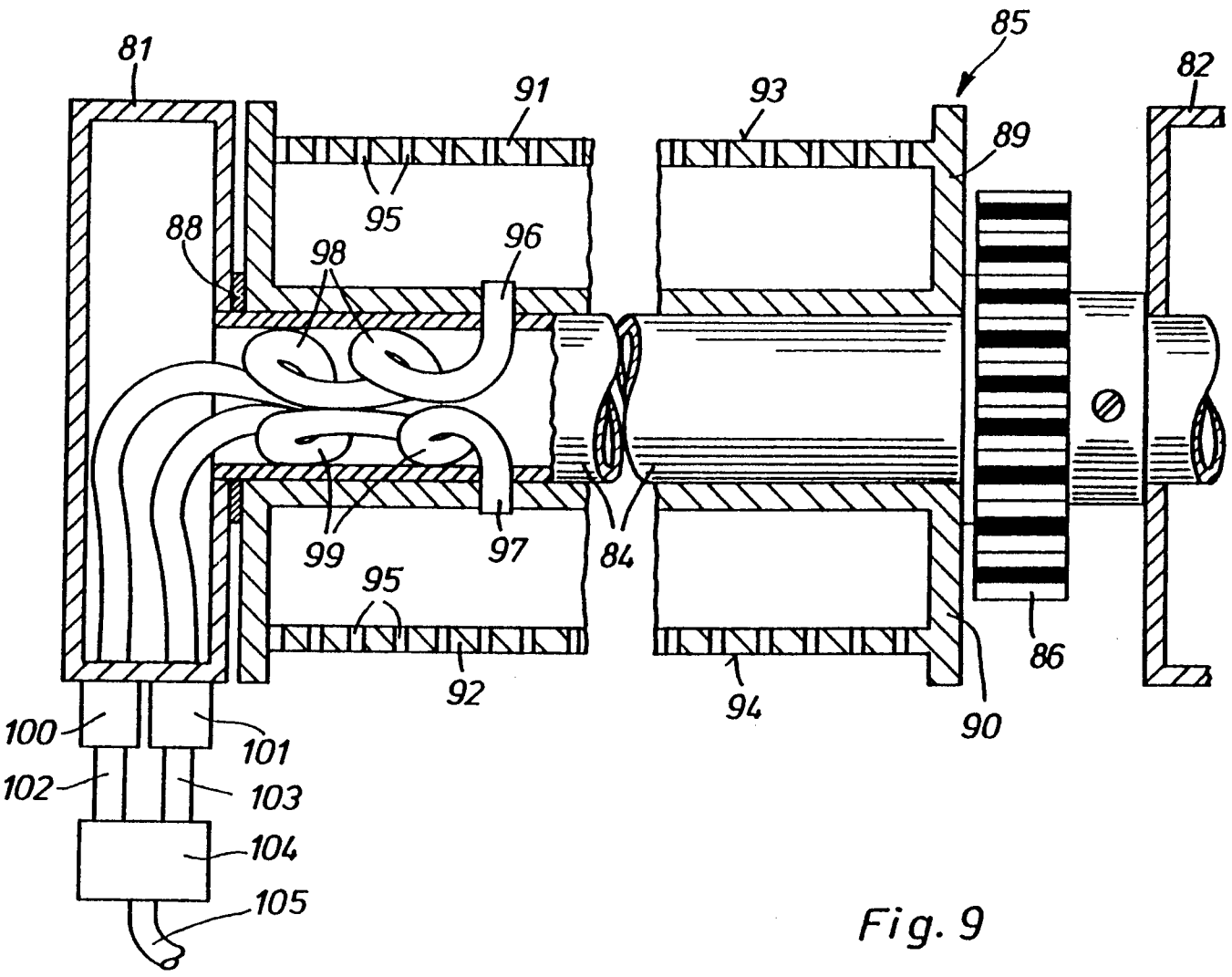
FIG. 9 is a partially cutaway view of a holding plate, according to the third embodiment of the invention, shown on a larger scale.

The device shown in FIGS. 7 through 9 has a frame 80 which has, among other things, three hollow support strips 81, 82, 83, which are arranged in parallel to and at spaced locations from one another. Two holding plates 85 are nonrotatably arranged on a shaft 84 mounted in the support strips 81, 82, 83. A sprocket wheel 86 of a chain drive 87 is clamped on the hollow shaft 84 between the left holding plate 85 and the central support strip 82 (FIG. 9). In conjunction with a spacer ring 88 pushed over the hollow shaft 84 between the left support strip 81 and the holding plate 85, the sprocket wheel 86 brings about axial holding for the hollow shaft 84. After the hollow shaft 84 has been axially secured by the sprocket wheel 86 and the spacer ring 88, the right holding plate 85 located between the middle and right support strips 82, 83, respectively, can be mounted nonrotatably on the hollow shaft 84 without additional axial holding means.

The holding plates 85 consist of two flat reservoirs 89, 90 arranged symmetrically to the hollow shaft 84 with two recessed receiving plates 91, 92 each, whose outside forms a receiving surface 93, 94 each. The receiving plates 91, 92 contain a plurality of passage holes 95. As is shown in FIG. 9 on the basis of the holding plate 85, a respective hose pipe 96 or 97, which is passed through corresponding, mutually aligned holes (not shown in detail) within the hollow shaft 84 and the respective reservoir 89, 90, opens into each of the two reservoirs 89, 90. The hose pipes 96, 97 extend in a plurality of turns 98, 99 within the hollow shaft 84 and are led into the hollow support strip 81 through their open ends. The hose pipes 96, 97 extend within the support strip 81 to the vicinity of the end facing away from the hollow shaft 84, where they are led out of the support strip 81, and are connected to a directional control valve 100, 101 each. Connection lines 102, 103 lead from the directional control valves 100, 101 to a distributor 104. The distributor 104 is connected to a suction blower 106 via an individual hose pipe 105.

The right holding plate 85 has exactly the same design as the left holding plate 85 shown in FIG. 9, and is connected to the suction blower 106 in the same manner, so that it is unnecessary to describe this in detail. In this regard FIG. 8 shows only the hose pipe 107 leading from the distributor (not shown) to the suction blower 106.

As in the case of the receiving plates 4 of the first embodiment, templates (not shown) for the upper parts of the compound workpiece to be joined can be detachably fastened to the two receiving plates 91 and 92 of each the holding plate 85.

The chain drive 87 connected to the hollow shaft 84 is in driving connection with a positioning motor 108, which is able to rotate the two holding plates 85 together to and fro through 180° each.

A slide 110 is arranged displaceably on a guide rail 109 extending in parallel to the longitudinal axis L3. The slide 110 is connected to a positioning motor 112 via a chain drive 111. Another slide 114 is arranged displaceably on a guide rail 113 extending vertically and arranged on the slide 110. A pneumatic cylinder 115, whose piston rod 116 is connected to the slide 114, is fastened on the slide 110. The slide 114 and the pneumatic cylinder 115 form a lifting device 117. A bracket 118 projecting transversely, which carries a support plate 119 for one or several lower parts (not shown), is fastened to the slide 114.

Like the support plate 27 of the first embodiment, the support plate 119 is designed as a flat reservoir, and therefore, it has, like the support plate 27, a recessed receiving plate 121, which is provided with passage holes 120 and whose top side, located in a horizontal plane, forms a receiving surface 122. A template (not shown) for one or several lower parts can be placed over the receiving plate 121. A suction blower 123, which is connected to the cavity beneath the receiving plate 121, is fastened on the underside of the bracket 118.

A program-controlled adhesive applying device 124 has the same design as the adhesive applying device 34 according to the first embodiment, and therefore it comprises an adhesive applying head 126 arranged on a bracket arm 125. The bracket arm 125 is mounted displaceably on a rail-like longitudinal slide 127, and is connected via a chain drive 128 to a positioning motor 129 fastened on the longitudinal slide 127. The longitudinal slide 127 is arranged displaceably, via two cross slides 130, on two guide rails 131 extending at right angles to the longitudinal axis L3, and is connected via a chain drive 132 to a positioning motor 133.

At the beginning of the joining process, the support plate 119 is in the starting position shown in FIGS. 7 and 8, in which it is located on the side of the two holding plates 85, and in which the receiving surface 122 is essentially flush with the top receiving surfaces 93 of the two holding plates 85.

After the individual workpiece parts to be joined to one another have been placed on the receiving surfaces 93, 122 of the holding plates 85 and the support plate 119, the suction blower 123 of the support plate 119 and the suction blower 106 of the holding plates 85 are turned on. Furthermore, the directional control valve 100 for the left holding plate 85 and the corresponding directional control valve (not shown) for the right holding plate 85 are opened. The workpiece parts are then fixed on the receiving surfaces 93 and 122 by suction.

Using the adhesive applying device 124, adhesive is subsequently applied to the upper parts arranged on the holding plates 85, namely, to the edge zones which will later overlap after the workpiece parts have been joined.

While adhesive is being applied, the support plate 119 is lowered by means of the lifting device 117 to the extent that the top side of the support plate 119 or the lower part arranged on it will be located at a vertically spaced location from the horizontally extending plane of the underside of the holding plates 85.

As soon as the adhesive application process has been terminated, and the adhesive applying head 126 has been removed from the area of the holding plates 85, the holding plates 85 are rotated by the positioning motor 108 through 180° around the longitudinal axis L3, as a result of which the receiving plates 91 together with the upper parts placed on them will be at the bottom. Due to the coiled arrangement of the hose pipes 96, 97 within a hollow shaft 84, the end opening into the respective reservoir 89, 90 and the area adjoining of the hose pipes 96, 97 will rotate together with the holding plate 85, without pulling forces being applied to the part of the hose pipes 96, 97 located within the hollow strip 81.

After the holding plates 85 have been turned, the support plate 119 is moved by means of the positioning motor 112 under the left holding plate 85, after which it is raised by the lifting device 117 to the extent that the lower part and the upper part will touch one another, and, will adhere to one another due to the adhesive applied to the upper part. The directional control valve 100 is subsequently closed, and the suction air and consequently the holding action on the receiving plate 91 are thus interrupted. The support plate 119 is subsequently lowered again, and the upper part adhering to the lower part is removed from the holding plate 85. The support plate 119 is subsequently moved under the right holding plate 85, and the next upper part is gathered in the above-described manner.

During the gathering of the upper parts hanging on the receiving plates 91 facing downward, the upper parts for the next compound workpiece are placed over the receiving plates 92 now facing upward, and adhesive is subsequently applied to them. This leads to a time-saving, overlapping mode of operation.

While specific embodiments of the invention have been shown and described in detail to illustrate the application of the principles of the invention, it will be understood that the invention may be embodied otherwise without departing from such principles.

What is claimed is:

1. A device for joining a two-dimensional compound workpiece consisting of one lower part and one or several upper parts, such as a shoe upper consisting of a plurality of parts, comprising: a support plate having a receiving surface for at least one lower part; holding plates each having a receiving surface, for holding one or more parts, one of said support plate and holding plates including holding means for holding a part to one of said support plate and holding plate; driving means connected to one of the support plate and holding plates for performing relative movements between the support plate and holding plates in order to apply the upper part to the lower part, said holding plates being arranged adjacent one another, substantially along a longitudinal axis extending substantially horizontally, said driving means for moving said support plate from a starting position adjacent an outer one of said holding plates, relative to the holding plates, in parallel to said longitudinal axis and at right angles to said longitudinal axis to position said support plate such that a receiving surface of said support plate, carrying said lower part, can be successively positioned in a plurality of predeterminable positions relative to a receiving surface of said holding plate, carrying said at least one upper part, in which positions said respective receiving surfaces are disposed opposite to each other.

2. A device according to claim 1, wherein said driving means includes a slide, said support plate being arranged on said slide, said slide being connected to a guide rail for movement along said guide rail, said guide rail extending in parallel along said longitudinal axis of said holding plates, said slide being connected to a positioning drive and a lifting device for movement at right angles relative to said holding plates and being connected to a pivoting device for pivotal movement around a horizontal axis, said horizontal axis extending at right angles to said longitudinal axis of the holding plates, for movement between said starting position in which the receiving surface is at the top into a transfer position in which the receiving surface is at the bottom.

3. A device according to claim 1, wherein said drive means includes a slide, said support plate being arranged on said slide, said slide being moveable along a guide rail, said guide rail extending in parallel to said longitudinal axis of said holding plates, said slide being connected to a positioning drive and a pivoting device, for pivotal movement around an axis extending in parallel to said longitudinal axis of said holding plates, for movement between a starting position and a transfer position, in which a support plate is located behind one of the outer holding plates in a starting position, with the receiving surface at the top, substantially in the same plane as the receiving surface of the holding plate and in the transfer position with the receiving surface at the bottom, with the receiving surface overlapping one of the holding plates.

4. A device according to claim 1, wherein said holding plates are provided with one receiving surface on each side, said drive means including a pivoting device provided symmetrically with respect to said longitudinal axis for pivoting said holding plates, said support plate being disposed on a slide for movement in parallel to said longitudinal axis, said slide being connected to a positioning drive and a lifting device for movement from a starting position located on one side of an outer holding plate, in said starting position a receiving surface of said support plate is essentially flush with an upper receiving surface of said holding plate, into a plane located beneath a lower receiving surface of said holding plate, for successively positioning said support plate receiving surface in said plane in a plurality of predeterminable positions relative to the receiving surfaces of the holding plate.

5. A device according to claim 4, further comprising a second support plate associated with said first support plate, said second support plate being moveable by said drive means independently from the movement of said first support plate, from a starting position located on a side of another outer holding plate along a path corresponding to the path of the first support plate by means of drives corresponding to the positioning drive or to the lifting device of said first support plate.

6. A device according to claim 4, wherein said support plate can be raised at positioning locations into a zone of the lower receiving surfaces of the holding plates.

7. A device according to claim 5, wherein one of said support plate or said second support plate can be raised in positioning locations into a zone of the lower receiving surfaces of the holding plates.

8. A device according to claim 2, wherein said holding means includes forming one of said support plate and said holding plates as chambers connected to a suction blower, wherein said one of said support plate and said holding plates includes receiving surfaces provided with passage holes communicating with said chamber.

9. A device according to claim 3, wherein said holding means includes forming one of said support plate and said holding plates as chambers connected to a suction blower, wherein said one of said support plate and said holding plates includes receiving surfaces provided with passage holes communicating with said chamber.

10. A device according to claim 4, wherein said holding means includes forming one of said support plate and said holding plates as chambers connected to a suction blower, wherein said one of said support plate and said holding plates includes receiving surfaces provided with passage holes communicating with said chamber.

11. A device for joining a two-dimensional compound workpiece consisting of one lower part and one or several upper parts, comprising: a support plate said support plate including a receiving surface and holding means for holding at least one lower part; holding plates, said holding plates including receiving surfaces and holding means, for holding one or more parts; driving means connected to one of said support plate and said holding plates for performing relative movements between said support plate and said holding plates in order to apply the upper part to the lower part, said holding plates being arranged adjacent one another, substantially along a longitudinal axis extending substantially horizontally, said driving means for moving said support plate from a starting position, adjacent an outer one of said holding plates relative to the holding plates, in parallel to said longitudinal axis and at right angles to said longitudinal axis to position said support plate such that said receiving surface of said support plate, carrying said lower part, can be successively positioned facing a receiving surface of each one of said holding plates, carrying at least one upper part, in which said receiving surface of said support plate and said receiving surface of said support plates are disposed opposite to each other.

12. A device according to claim 1, wherein said starting position of said support plate is located to a side of said outer one of said holding plates.

13. A device according to claim 1, wherein said starting position of said support plate is located in an area of an edge of the device behind said outer one of said holding plates.

14. A device for joining a two-dimensional compound workpiece consisting of one lower part and one or several upper parts, comprising:

a support plate, said support plate including a receiving surface;

a plurality of holding plates, said holding plates including receiving surfaces, said holding plates being arranged adjacent one another, substantially along a longitudinal axis extending substantially horizontally;

holding means connected to one of said support plate and said holding plates for holding one or more parts to said one of said support plate and said holding plate; and driving means connected to one of said support plate and said holding plates for relative movement between said support plate and said holding plates for application of the one or several upper parts to the one lower part, said relative movement including movement in parallel to said longitudinal axis and at right angles to said longitudinal axis from a starting position wherein said support plate is adjacent an outer one of said holding plates to a joining position with said receiving surface of said support plate, carrying said lower part, positioned facing one of said receiving surfaces of said holding plates, carrying one or more of said several upper parts whereby said receiving surface of said support plate and said one of said receiving surfaces of said holding plates are disposed in opposite facing relationship to each other.

* * * * *